US011647875B2

(12) United States Patent
Bailey et al.

(10) Patent No.: US 11,647,875 B2
(45) Date of Patent: May 16, 2023

(54) COLLAPSIBLE CHILD TOILET SEAT

(71) Applicants: Ryan Bailey, Coronado, CA (US); Ji Hyun Chon, Coronado, CA (US)

(72) Inventors: Ryan Bailey, Coronado, CA (US); Ji Hyun Chon, Coronado, CA (US)

( * ) Notice: Subject to any disclaimer, the term of this patent is extended or adjusted under 35 U.S.C. 154(b) by 0 days.

(21) Appl. No.: 17/327,371

(22) Filed: May 21, 2021

(65) Prior Publication Data

US 2021/0361129 A1 Nov. 25, 2021

Related U.S. Application Data

(60) Provisional application No. 63/028,526, filed on May 21, 2020.

(51) Int. Cl.
*A47K 13/06* (2006.01)

(52) U.S. Cl.
CPC ..... *A47K 13/06* (2013.01)

(58) Field of Classification Search
CPC ..... A47K 13/06; A47K 13/005
USPC ..... 4/239
See application file for complete search history.

(56) References Cited

U.S. PATENT DOCUMENTS

| | | | | | |
|---|---|---|---|---|---|
| 396,803 | A * | 1/1889 | Breher | A47K 13/06 | 4/239 |
| 1,410,427 | A * | 3/1922 | Turnquist | A47K 13/06 | 4/239 |
| 1,633,222 | A * | 6/1927 | Noble | A47K 13/06 | 4/239 |
| 2,443,068 | A * | 6/1948 | Dahle | A47K 13/06 | D23/311 |
| 3,261,030 | A * | 7/1966 | Blem | A47K 13/02 | D23/311 |
| 5,005,223 | A * | 4/1991 | Greenwood | A47K 13/06 | 4/245.3 |
| 6,986,173 | B1 * | 1/2006 | Hickey | A47K 13/005 | 4/240 |
| 2016/0183745 | A1 * | 6/2016 | Jackson | A47K 13/14 | 4/240 |
| 2020/0178739 | A1 * | 6/2020 | Evans | A47K 13/14 | |

OTHER PUBLICATIONS

Item 1: See attached URL information; Site last visited: Feb. 11, 2021.
Item 2: See attached URL information; Site last visited: Feb. 11, 2021.
Item 3: See attached URL information; Site last visited: Feb. 11, 2021.

* cited by examiner

*Primary Examiner* — Benjamin R Shaw
(74) *Attorney, Agent, or Firm* — Donn K. Harms

(57) ABSTRACT

A portable toilet seat for child toilet training is provided. The portable seat is configurable between a deployed position for use atop a conventional toilet seat and a retracted position for storage and transport.

16 Claims, 9 Drawing Sheets

COLLAPSIBLE CHILD TOILET SEAT

This application claims priority to U.S. Provisional Patent Application Ser. No. 63/028,526 filed on May 21, 2020, which is incorporated herein in its entirety by this reference thereto.

FIELD OF THE INVENTION

The field of the invention relates to child toilet training and the general comfort of small children when sitting atop conventional toilet seats. More particularly, this invention relates to a toilet seat device which is both storable in a collapsed configuration and employable to support an infant, toddler, or small child atop a conventional toilet seat when unfolded to a deployed configuration.

BACKGROUND OF THE INVENTION

In the United States and in many industrialized countries, toilet training is the process of training someone, particularly an infant, toddler, or small child, to use the toilet for urination and defecation. For parents and caregivers having small children in their care the process of educating the child to use a toilet rather than the diaper they have become used to since birth can be easy in some cases, such as when the child has older siblings setting an example. However, in other cases such can be an ordeal.

One significant issue facing parents and guardians during such training is that toddlers and small children, being small in stature, are not easily positionable atop a conventional toilet seat. Such conventional toilet seats, be they at home or in a public restroom, are configured for supporting an older child or adult atop the toilet during use. Toddlers and young children, being small in stature, must balance on the edge portions of a conventional toilet seat or be held steady by the adult caring for them at the time. While such a balancing act may work when toilet training is conducted at home, it is less than desirable when having to use a public restroom, all the more so given the conventional large open-front seats frequently used in such environments. The issue is such that some caregivers may decide to place children who are largely potty trained when in the home environment back into diapers for purposes of going out in public. This reintroduction of diapers can confuse children and cause a regression in potty training.

As such, children may face certain risks associated with toilet training and using conventional-sized toilets in general, such as slipping or falling from toilet seats. Further, trying to form an insulating barrier between the body of a child and a public toilet seat that can be maintained during use is a task not easily accomplished. Thus, even if the child can somehow maintain their position atop a conventional toilet seat, they still are at risk of contacting germs and bacteria from the underlying seat should the paper or other interface between the child and the underlying seat fail.

The forgoing examples of related art as to toilet seats and the perils of toilet training for infants, toddlers, and young children are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The toilet seat device herein is configured in a manner to provide the user with significant utility over prior art. The toilet seat device has a body which is collapsible to a very compact configuration for storage and transport. From this collapsed configuration, the body of the device is easily reconfigured to a deployed configuration, wherein a non-slip skirt or flange extending from the bottom surface of the device is configured to securely engage atop an existing toilet seat in the home or while traveling.

In all modes of the toilet seat device herein, the device has a substantially U-shaped body formed of a first body portion and a second body portion which surround a central opening. The first body portion is in a first pivoting engagement with the second body portion. The first body portion is formed of a first segment which is in a second pivoting engagement with a second segment. In a similar fashion, the second body portion is formed of a third segment in a third pivoting engagement with a fourth segment. It is the plurality of pivoting engagements which configure the device to easily move between a highly compact collapsed configuration for storage and travel to a deployed configuration which is easily positioned for a secure engagement atop a toilet seat in the home or in a restroom when traveling.

By pivoting engagement, herein, is meant any rotating connection engaging two body portions and/or two segments of the device herein. For example, and in no way limiting, hinge members engaged with one body portion may be rotationally connected by a pin or axle with other hinge members engaged with a second body portion.

A particularly preferred pivoting engagement employed for at least one pivoting engagement between the segments of the body of the device includes structure to generate a "click to open" and a "click to close" feature. In addition to generating a noise for the user and a vibration to the device which may be felt by the user such also imparts a bias of the engaged segments toward each other to form a biased contact thereof. Currently, such is provided by first and second projections on the hinge or pivoting engagement, which cause a deflection or snapping movement of complementary recesses located on one of the segments engaged in the pivoting engagement.

In operation, when the segments so engaged are being folded or unfolded, the projections will cause the respective leading edges of the respective complementary recesses to momentarily deflect subsequently snap back to an original positioning as it descends into the recess. This snap back movement itself will generate a noise and/or vibration and concurrently causes the endwalls of the opposing segments to collide against each other, thereby generating a further noise for an auditory signal and/or concurrently communicating a tactile sensation or vibration into the body of the device which may be felt by the user. This vibration and noise is preferable during unfolding of the device to the deployed position, because the noise and/or vibration alerts the user that the device is locked in the deployed position. A similar tactile and audible operation occurs with a first pivoting engagement between the first and second body portions of the device.

One particularly preferred aspect of the above noted structure included as part of the pivoting engagement is that it locks the toilet seat device in the fully deployed position under normal use conditions (i.e. the "first locked position") with endwalls adjacent each pivoting engagement in a biased contact with each other and that respective pivoting engagement in the first locked position. This biased contact eliminates gaps between the adjacent segments at the pivoting engagements, thereby eliminating a potential source of pinching of the skin of the child sitting atop the device. The locking aspect of this same structure further prevents pinching that would otherwise occur in the same location were the device to move slightly in and out of the deployed position as a result of the child's movement atop the device. Such moving in and out of the deployed position would result in the opening and closing of slight gaps between adjacent segments at the pivoting engagements that could grab and pinch the sitting child's skin.

This same structure allowing for the biased contact of the endwalls of adjacent segments at each pivoting engagement while in the first locked position, also provides the above noted auditory signal or feedback and/or tactile signal or feedback that notifies the caregiver-user the device is in the fully deployed position. This allows the caregiver-user to avoid placing the child on a seat that is not fully deployed, which can result in pinching of the skin as the endwalls of the adjacent segments come together.

A second aspect of the structure included in each such pivoting engagement provides an auditory signal or feedback and/or a tactile signal or feedback notifying the caregiver-user that the device is in the fully collapsed configuration (i.e. moved to the "second locked position"). This collapsed feedback is provided by pivoting engagements between the segments forming the first and second portions of the body and a pivoting engagement between the first and second portions of the body, where projections and recesses thereon are rotated to the second locked position to thereby hold the device in the fully collapsed configuration to prevent the device from partially deploying when stowed in the caregiver-user's bag. To move back to the deployed position and the first locked position of each pivoting engagement requires the user to exert force to overcome the lock formed at each pivoting engagement while in the second locked position and then to rotate each pivoting engagement to the first locked position where each pivoting engagement exerts a biasing force to bias the endwalls adjacent thereto to a biased contact with each other. Moving out of the first locked position for the plurality of pivoting engagements requires force exertion by the user to unlock each of the pivoting engagements and to rotate it back toward and to the second locked position.

As noted, using a folding sequence of the first and second segments, and the third and fourth segments, followed by a folding of the pivoting engagement between the first body portion and second body portion, the toilet seat device, herein, is folded from the enlarged deployed configuration to a collapsed configuration. In this highly compact collapsed configuration, the device is easily stowed in a purse or carrying case for use when needed, thereby encouraging ongoing use at home and during travel from the home to provide continuous toilet training to a toddler or simply a comfortable sitting platform for small-yet-toilet-trained children when faced with the need to sit atop a conventional toilet seat.

Particularly preferred in all modes of the device herein, is the formation and positioning of a first recess on the bottom surface of the body on the first segment of the first body portion and a second recess on the bottom surface of the body on the third segment of the second body portion. Through this recessed positioning, the second segment of the first body portion, when folded in the pivoting engagement, will be positioned within the first recess, and the fourth segment of the second body portion will settle into the second recess. So positioned in the respective recesses, when the first body portion is folded along the pivoting engagement with the second body portion, a significant enhancement to the compact volume of the device in the collapsed position is achieved over a mode of the device without such recesses.

In concert with the recesses formed in the bottom or lower surface of the body of the toilet seat device herein is the provision of a non-slip skirt or ledge extending around the exterior perimeter edge of the toilet seat device which is clearly visible in the deployed position. This skirt provides an especially secure, non-slip engagement when the body of the toilet seat device herein is positioned for use atop an underlying toilet seat. This skirt may be formed by an extending ledge which will form a non-slip contact with the underlying toilet seat. More preferably, the ledge will be formed of a pliable polymeric material which will slightly deform to match the contour of the surface of the underlying toilet seat, thereby increasing the amount of the surface area of the skirt or ledge in frictional engagement with the toilet seat below. Additionally preferred is that the pliable skirt or ledge is formed of a polymeric material or a thermoplastic elastomer having a durometer which is between Shore 40A and Shore 80A with a current favorite durometer being between Shore 45A and Shore 60A which has shown to be durable yet pliable and to enhance the frictional engagement with the toilet seat surface on top of which the toilet seat device herein is used when in the deployed configuration in an as-used positioning located atop the underlying toilet seat.

Further, the skirt or ledge extending substantially around the exterior circumference of the deployed seat device herein, helps maintain a separation distance for the skin and body of the user sitting atop the toilet seat device from the surface of the underlying toilet seat, which may not be in the most hygienic of conditions.

Additionally preferred in the toilet seat device is a shaping of the mating portions of the pivotally engaged segments with curved intersections of endwalls at each of the pivoting engagements between sections. These curved intersections of the endwalls with the top surface of the body of the device form a curved V-shape. Experimentation with differing shapes at the contact point between pivotally engaged segments forming the body has shown that forming complementary curves or curving endwalls at the upper corners of pivotally engaged segments where such corners communicate with the top surface of the body provide a significant enhancement in the prevention of pinching of the skin of a toddler or small child situated on the top surface during use. Where a small child is the user, the prevention of any negative feedback is paramount to the voluntary and enthusiastic use of the toilet seat device during toilet training.

With respect to the above description, before explaining at least one preferred embodiment of the herein disclosed collapsible toilet seat device in detail, it is to be understood that the invention is not limited in its application to the details of construction and to the arrangement of the components or method steps within the following description or illustrated in the drawings. The device and system herein described and disclosed in the various modes and combinations is also capable of other embodiments and of being practiced and carried out in various ways which will be obvious to those skilled in the art upon reviewing this disclosure. Any such alternative configuration or equivalent as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for the designing of other collapsible toilet seat devices and methods for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor the exclusive examples of embodiments and/or features of the disclosed collapsible toilet seat device. It is intended that the embodiments and figures disclosed herein are to be considered illustrative of the invention herein, rather than limiting in any fashion.

Figure 1:
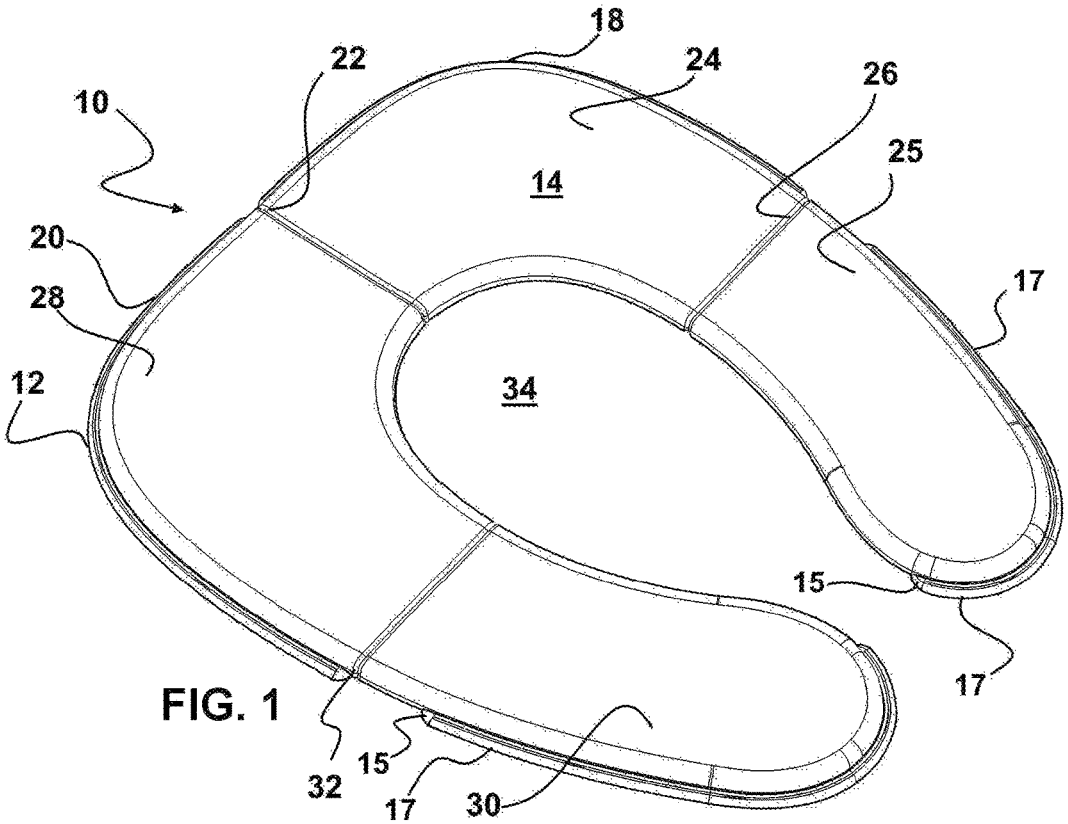
FIG. 1 depicts a top perspective view of the toilet seat device herein in a deployed configuration of the body thereof adapted for sitting atop a conventional toilet seat in an as-used positioning, to support a child thereon.
Figure 2:
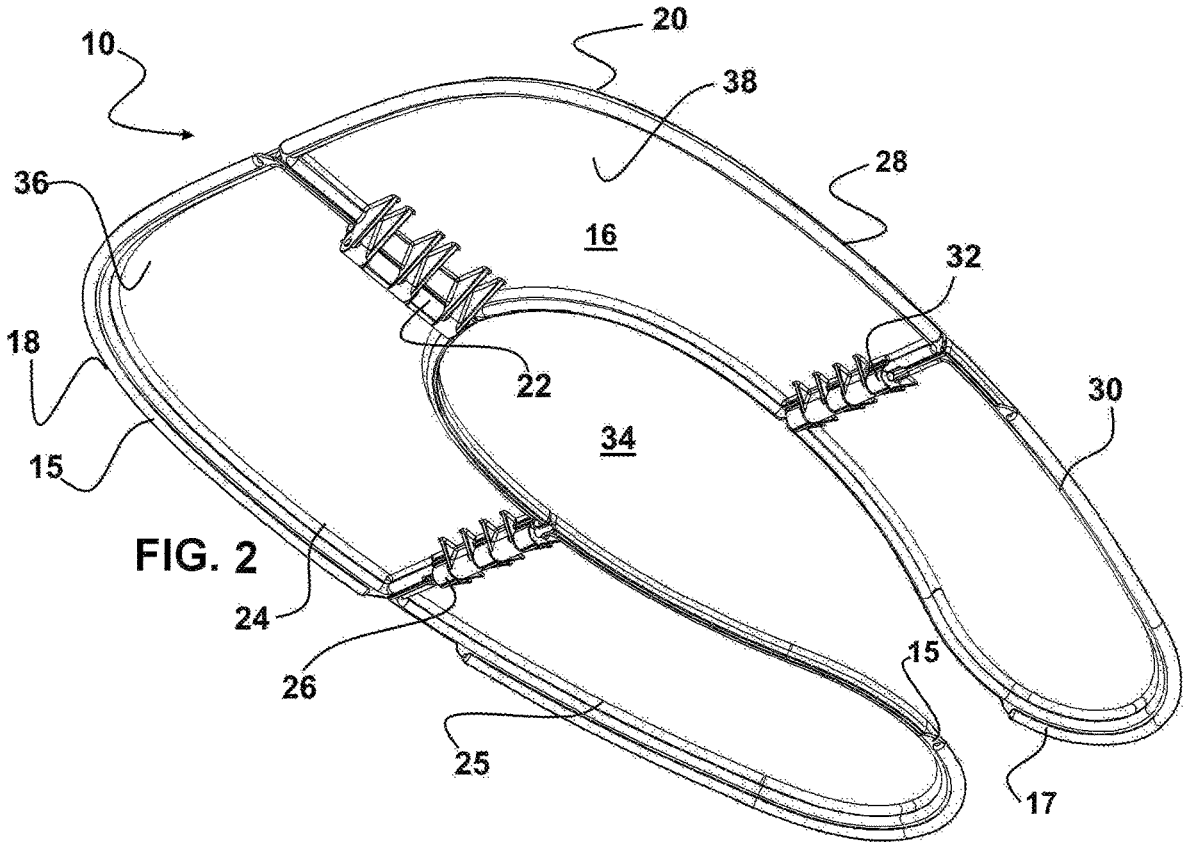
FIG. 2 depicts a perspective view of the bottom of the body forming the toilet seat device of FIG. 1 showing the pivoting engagement of a first body portion to a second body portion and the pivoting engagements of the multiple segments thereof having respective recesses formed therein.
Figure 3:
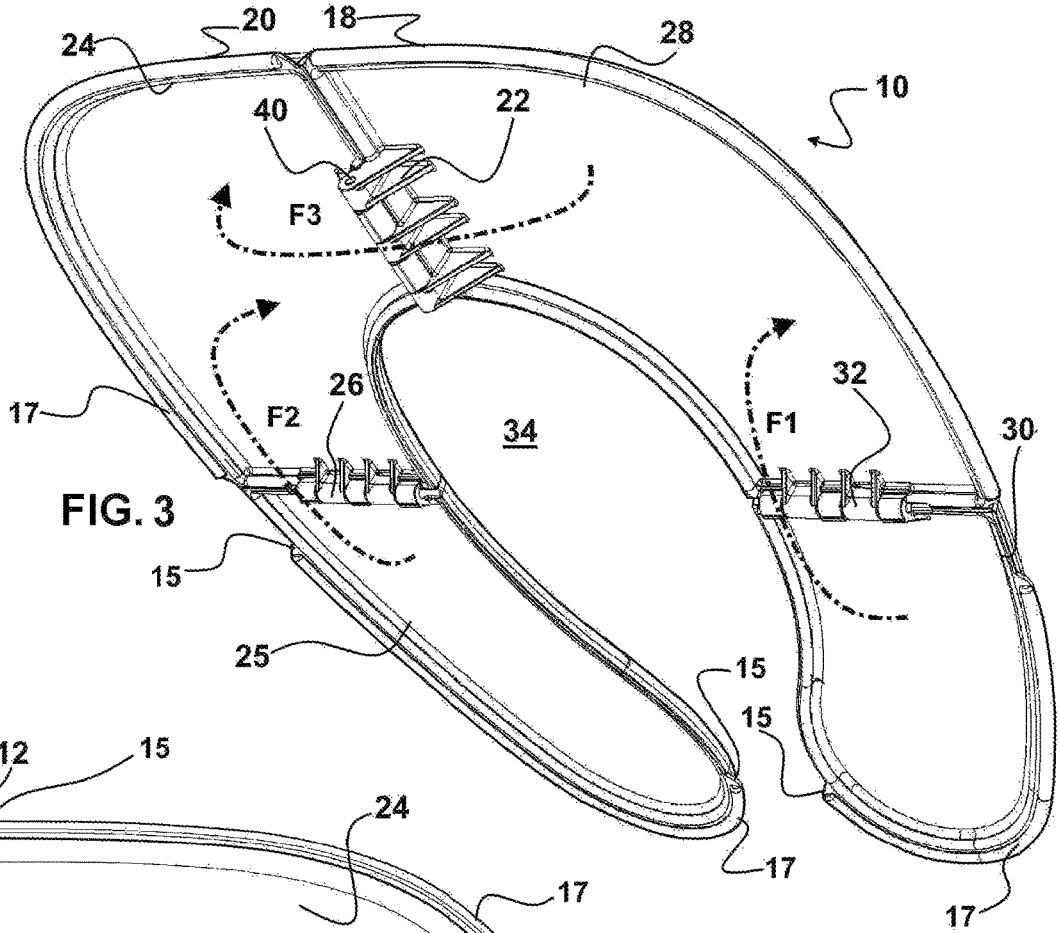
Figure 4:
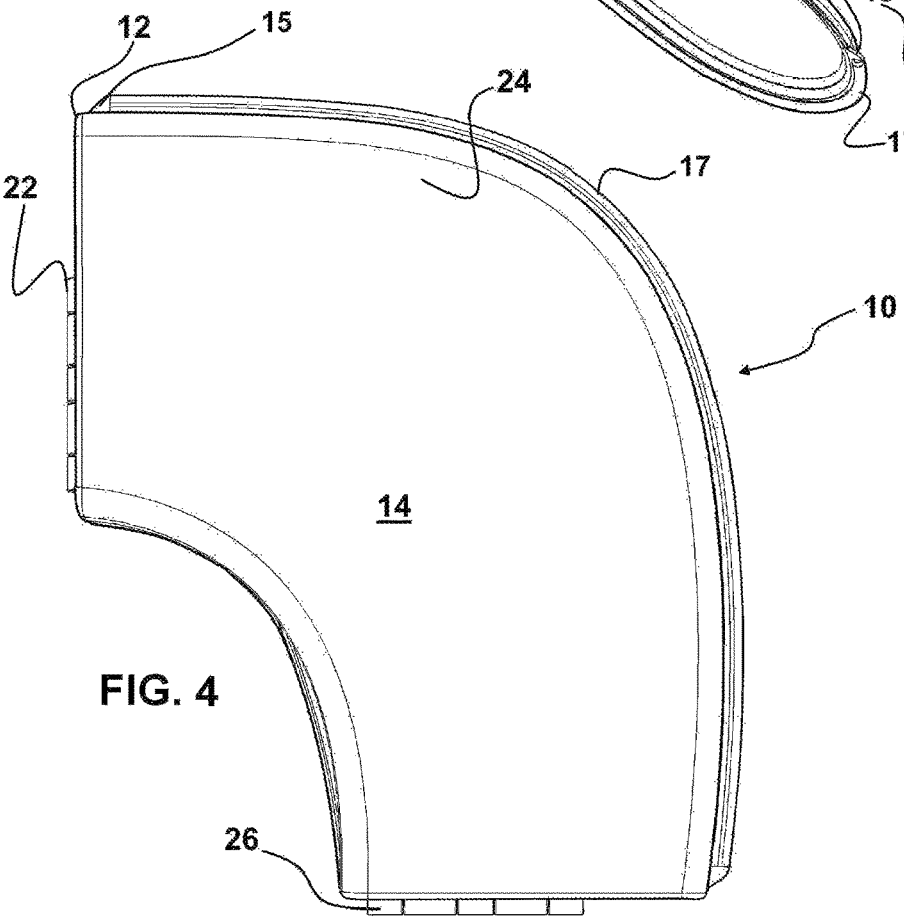

FIG. 3 shows a bottom view of the device of FIG. 1, from the same perspective view as FIG. 2, depicting a folding sequence in broken lines to move the multiple pivoting engagements from the first locked position of FIG. 2, to the second locked position, to both configure the toilet seat to the collapsed configuration of FIG. 4 from the deployed configuration of FIG. 1, and hold it in that position.

FIG. 4 shows the device of FIGS. 1-3 in a collapsed configuration subsequent to the folding sequence of FIG. 3 wherein all three pivoting engagements have been rotated to the second locked position.

Figure 5:
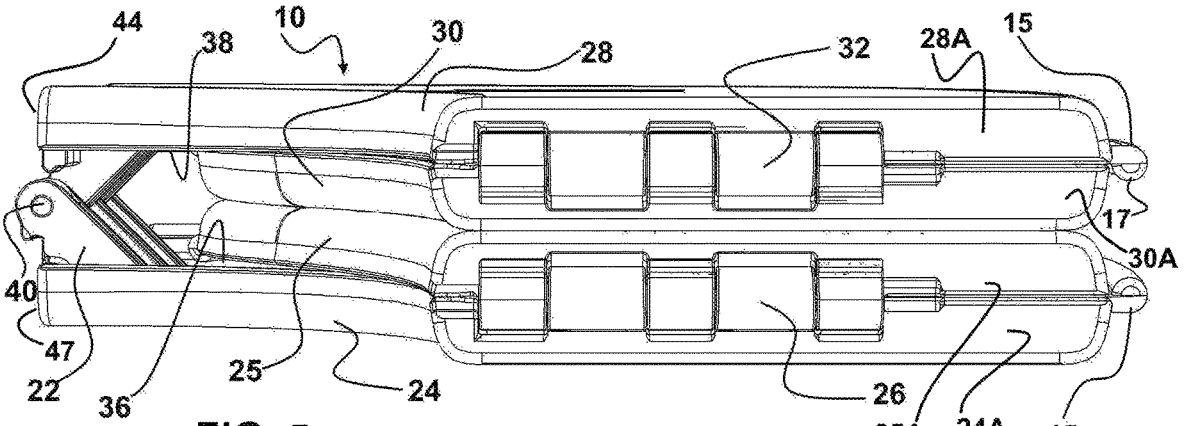

FIG. 5 depicts a side view of the device in the collapsed configuration of FIG. 4 showing the positioning of segments within recesses to significantly enhance the compactness of the device in the collapsed position of FIG. 4.

Figure 6:
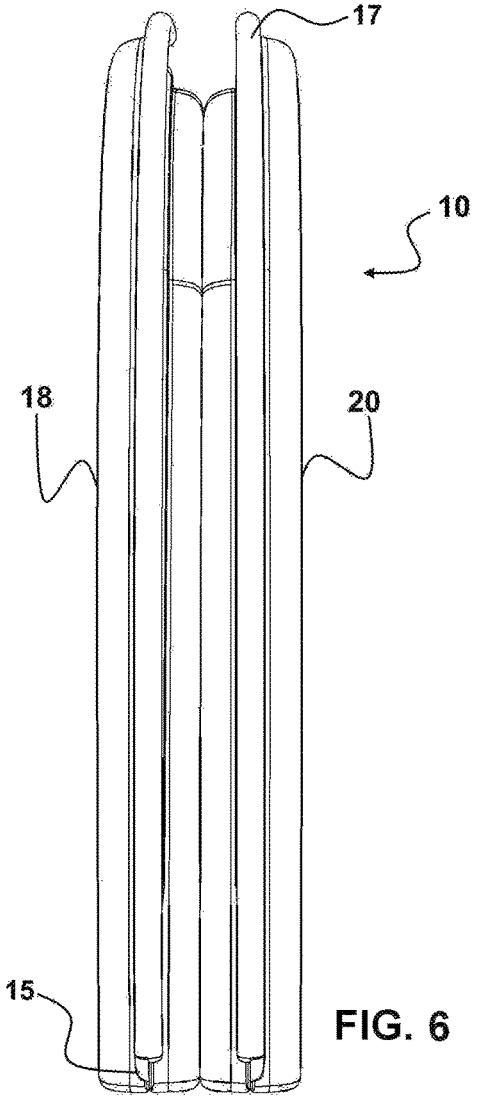

FIG. 6 is a view of the device from an opposite side of the device as depicted in FIG. 5 showing the compact positioning of segments within recesses.

Figure 7:
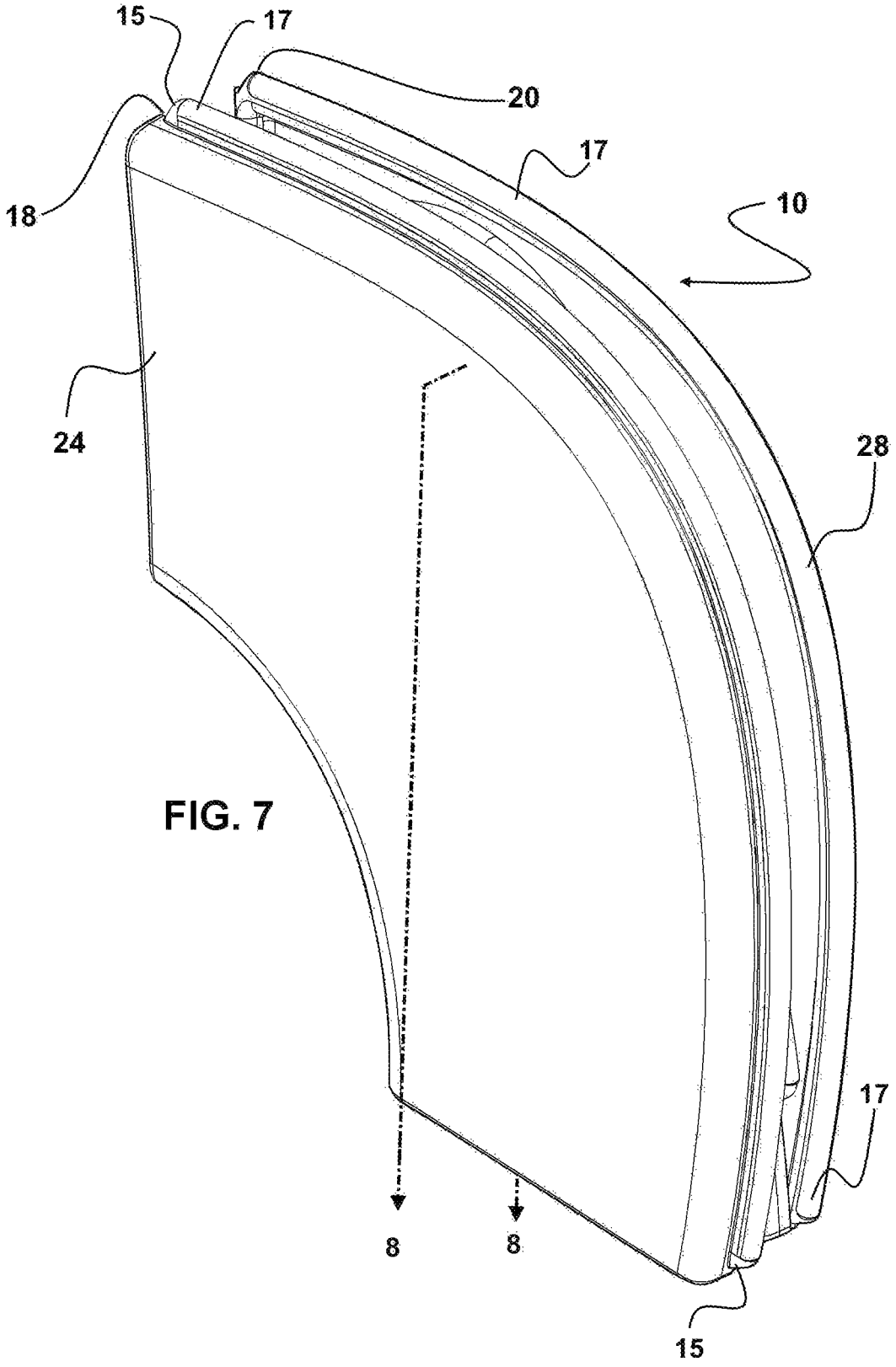
Figure 8:
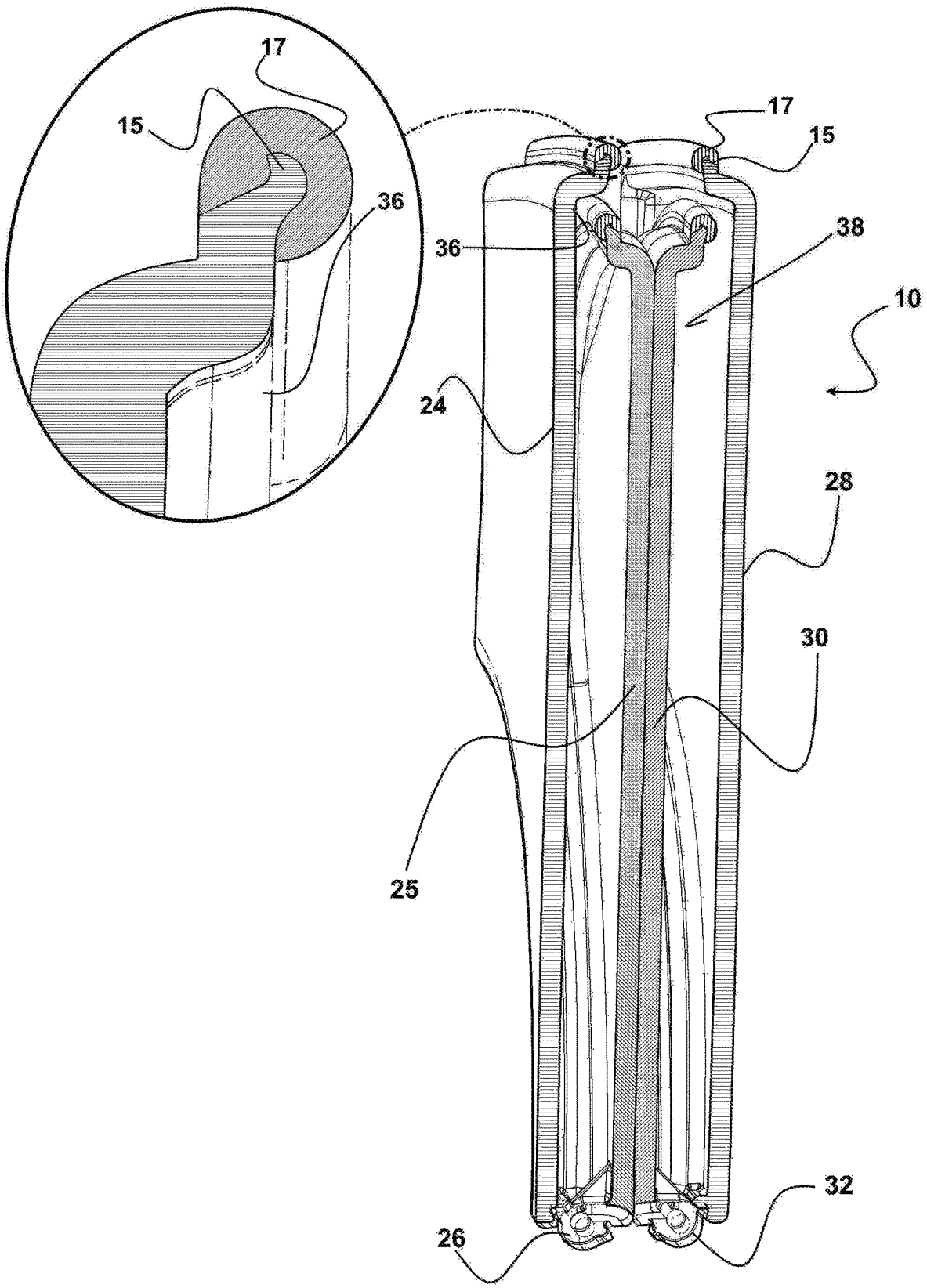

FIG. 7 shows the device of FIG. 4 in a perspective view and shows line 8-8 which refers to the sectional view therethrough in FIG. 8.

FIG. 8 depicts a sectional view through FIG. 7, along line 8-8 thereof, showing the device in the collapsed configuration with portions nesting within respective recesses on the first and second segments and also shows an enlarged depiction of the flange having a ledge consisting of a preferred pliable covering engaged thereon.

Figure 9:
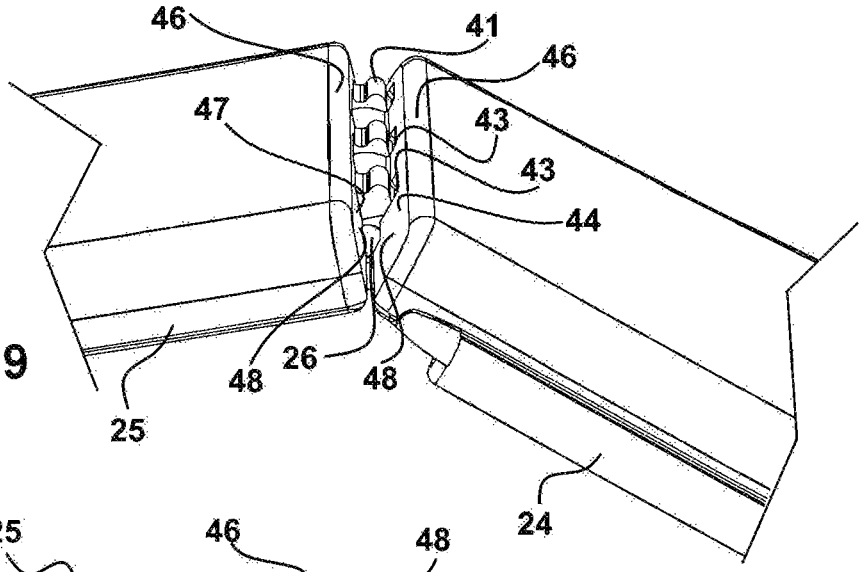

FIG. 9 depicts an outside perimeter view of the second pivoting engagement between the first and second segments of the toilet seat device, which operates in the same fashion as the third pivoting engagement between the third and fourth segments, enabling the movement between the deployed configuration of FIG. 1.

Figure 10:
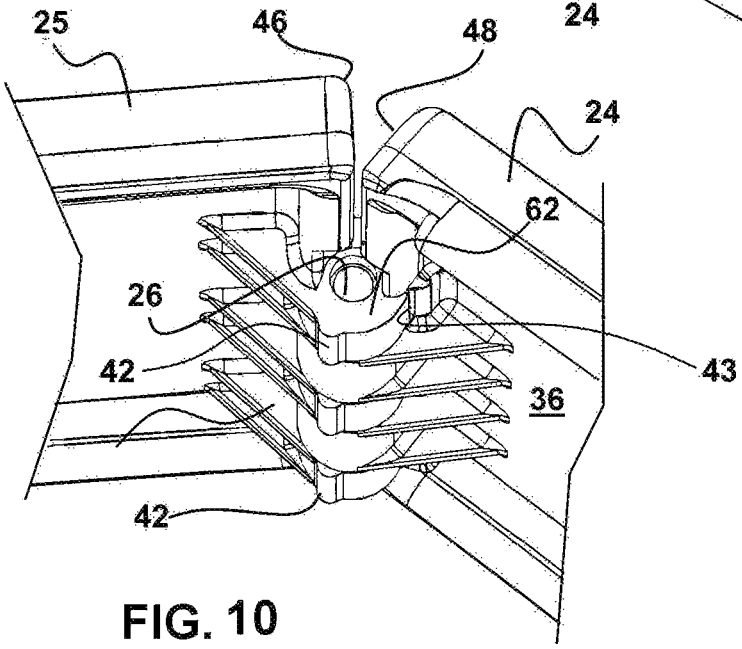

FIG. 10 depicts a lower perspective view of the second or pivoting engagement of FIG. 9, which is typical also of the third pivoting engagement, such as a hinge showing second projections which will removably hold respective segments in the collapsed position.

Figure 10A:
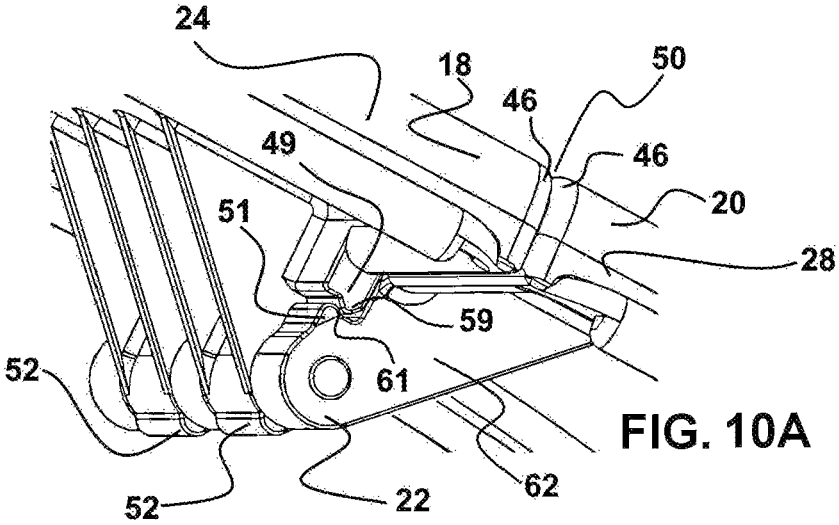
Figure 14:
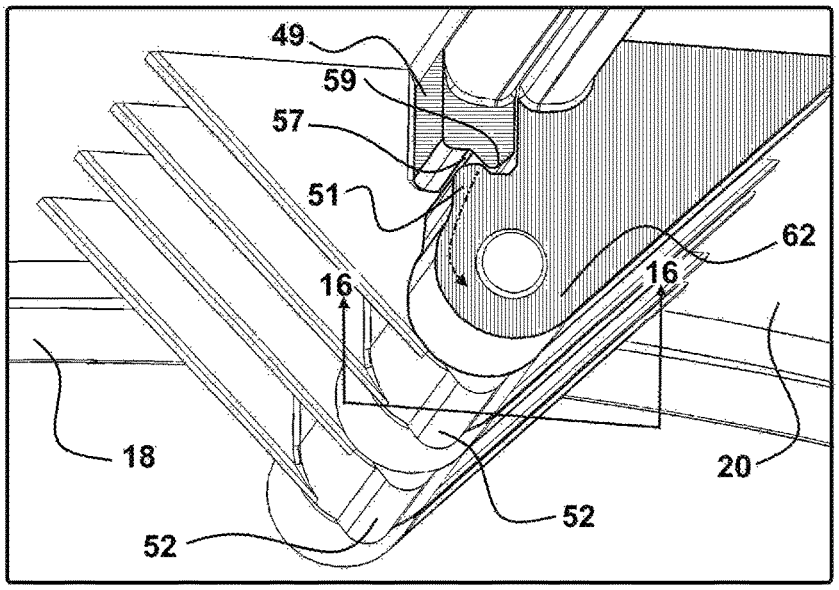
Figure 15:
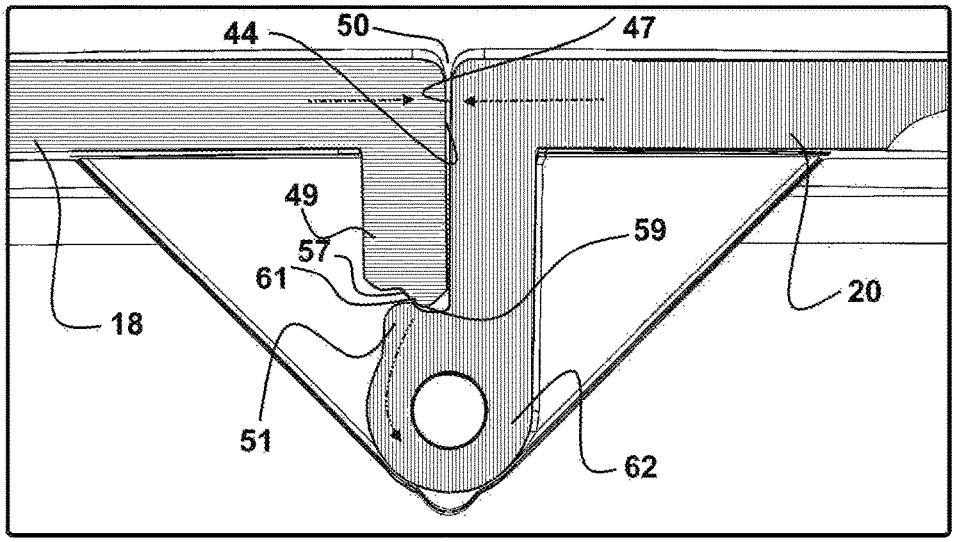
Figure 16:
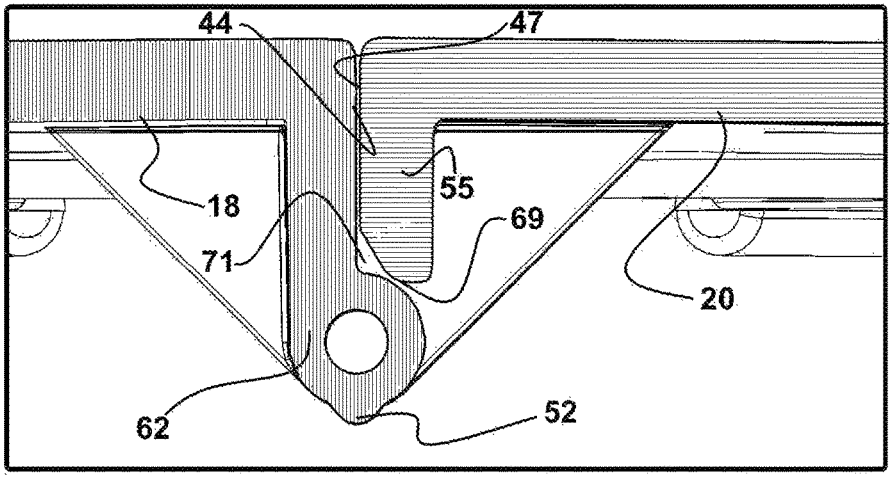

FIG. 10A shows a perspective view of the first pivoting engagement between the two body portions of the device as in FIGS. 14-16 which is depicted in the first locked position to maintain the device in the deployed configuration which maintains the endwalls in a biased contact such as in FIG. 1, and which can also be rotated to the second locked position to maintain the device in the collapsed configuration such as in FIG. 4.

Figure 11:
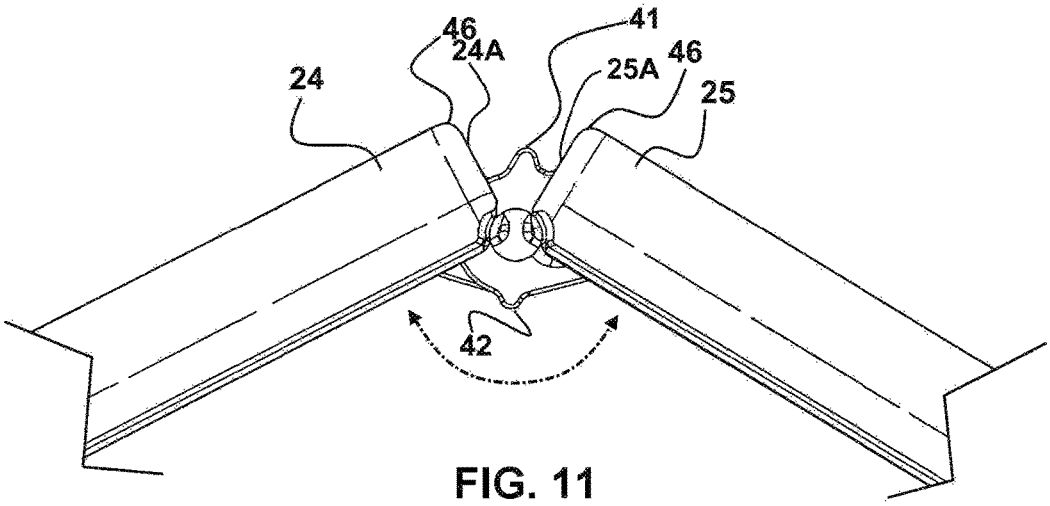

FIG. 11 shows two segments of the device in the second pivoting engagement which is substantially similar to that of the third pivoting engagement and formed by a hinge but viewed from the central opening of the toilet seat device.

Figure 12:
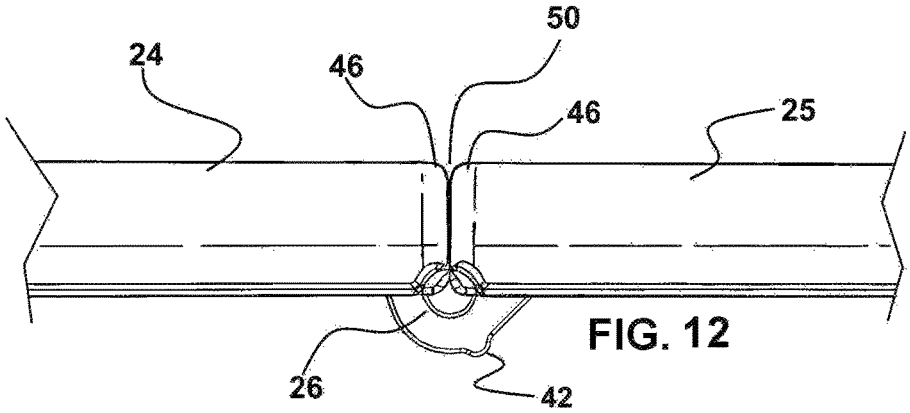
Figure 19:
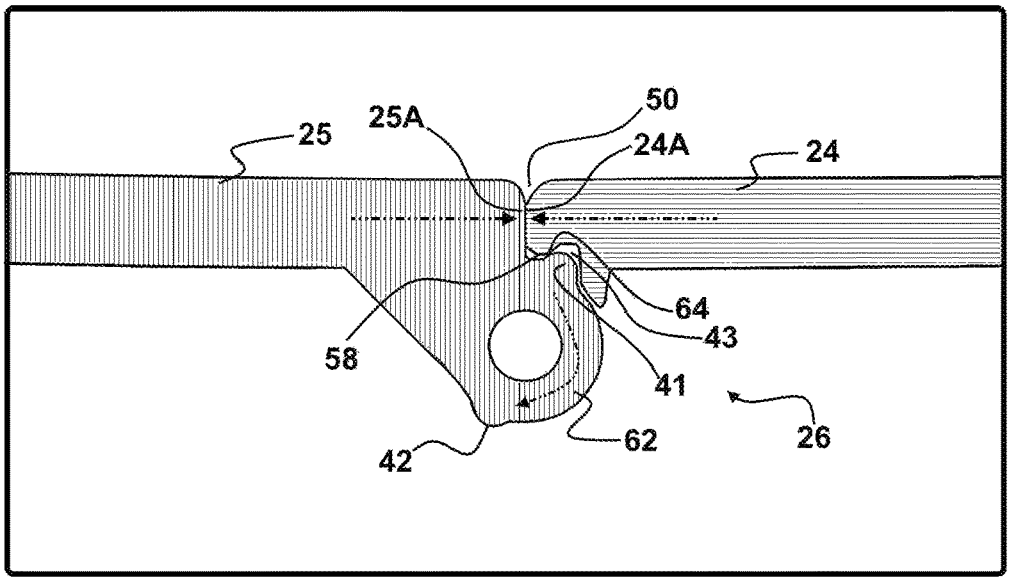

FIG. 12 shows the pivoting segments, such as in FIG. 11 and FIG. 19, rotated in the pivoting engagement to the first locked position yielding the deployed configuration of FIG. 1 and showing the biased contact of the endwalls of the segments imparted by the pivoting engagements and the particularly preferred curved sections on opposing segments, which form a no-pinch recess for seating atop the device.

Figure 13:
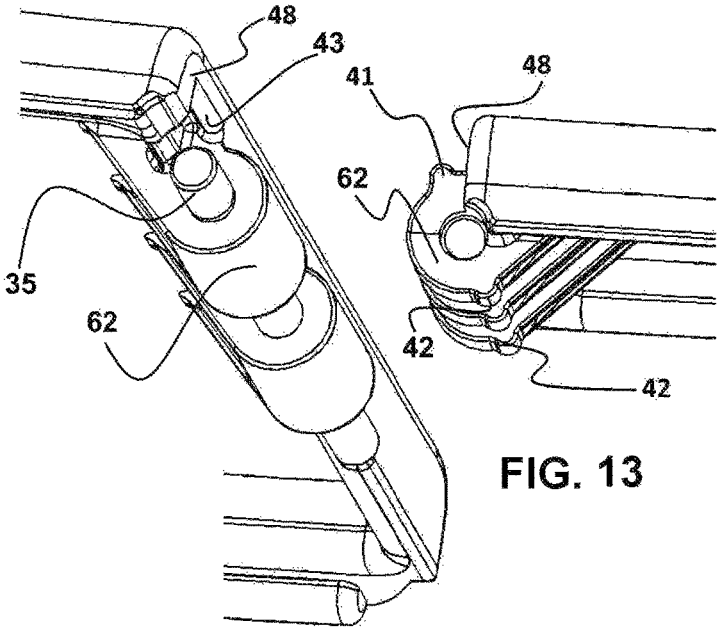

FIG. 13 depicts an exploded view of the second pivoting engagement which is substantially similar to the third pivoting engagement and formed by a hinge as is currently employed between the first and second and third and fourth segments of the device forming the two body portions.

FIG. 14 shows a perspective view of the first pivoting engagement in the first locked position as in FIG. 10A with hatching to more clearly show the different components forming a locked engagement.

FIG. 15 shows a side view of the first pivoting engagement of FIG. 14 and FIG. 10A showing the endwalls of the first body portion and second body portion held in a biased contact with each other by the first pivoting engagement in the first locked position, and showing the curved intersection of the endwalls with the top surface of the device.

FIG. 16 depicts a sectional view of the first pivoting engagement between the body portions of the device along line 16-16 of FIG. 14, and shows the secondary projection and the second locking member having a recess in which the secondary projection engages in the second locked position, to hold the body portions to the collapsed position.

Figure 17:
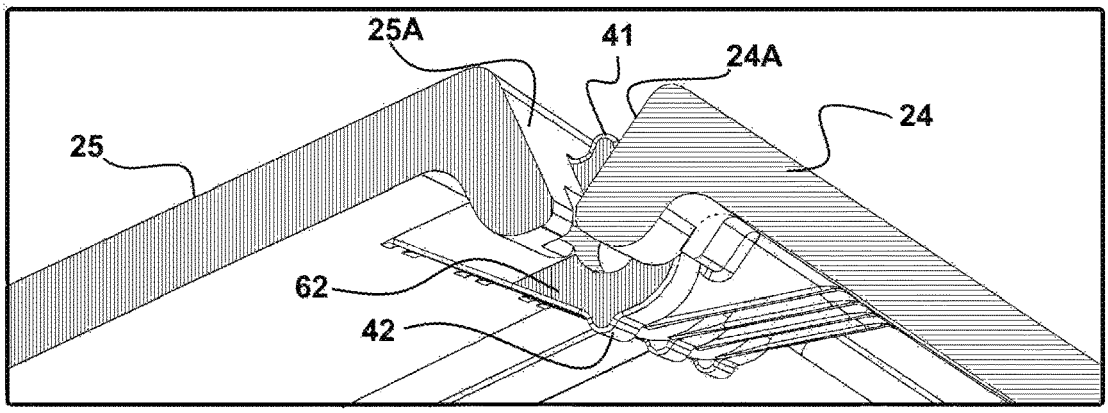

FIG. 17 is another view of the device as in FIG. 11 showing another view of the second pivoting engagement which, as noted, is of the same configuration as the third pivoting engagement having a hinge formed of opposing hinge members and a pin, which will impart a biased contact of the endwalls when in the first locked position shown in FIG. 19.

Figure 18:
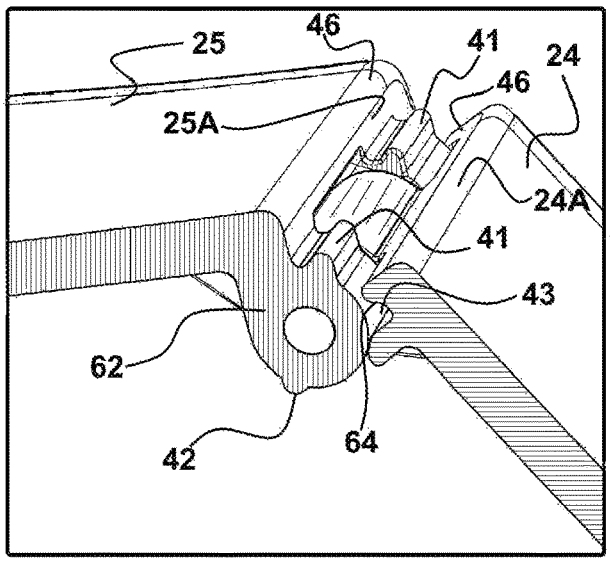

FIG. 18 shows a sectional view running through the hinge member of the second pivoting engagement of the device as in FIG. 17, which is the same configuration as the third pivoting engagement, which provides a clearer view of the first and second projections which engage against the sidewall of the complimentary recess to hold the device in the deployed and collapsed configurations with the endwalls in biased contact.

FIG. 19 shows the second pivoting engagement of FIGS. 17-18 rotated to the first locked position to show the biased contact of the endwalls of the engaged segments being forced towards each other as imparted by the first projection positioned against a sidewall of the complementary recess, and which is of the same operation and configuration in the third pivoting engagement.

Other aspects of the present toilet seat invention will be more readily understood when considered in conjunction with the accompanying drawings, and the following detailed description, neither of which should be considered limiting.

DETAILED DESCRIPTION OF THE PRESENT INVENTION

In this description, the directional prepositions of up, upwardly, down, downwardly, front, back, top, upper, bottom, lower, left, right and other such terms refer to the toilet seat device as it is oriented and appears in the drawings and are used for convenience only; they are not intended to be limiting or to imply that the device has to be used or positioned in any particular orientation.

Now referring to drawings in FIGS. 1-19, wherein similar components are identified by like reference numerals, there can be seen in FIG. 1 the disclosed collapsible toilet seat device 10 herein, in a deployed configuration of the body 12 thereof showing an upper surface 14 opposite the lower surface 16 shown in FIG. 2. In this deployed configuration of FIGS. 1-2, the device 10 is adapted for positioning to an as-used or mounted position atop a conventional toilet seat, with a flange 15 which preferably has a pliable cover 17 engaged thereon, in contact with the top surface of the conventional toilet seat. In this mounted position, the upper surface 14 of the device 10 herein, is positioned whereby a toddler or small child may sit thereon, supported over the underlying conventional toilet (not shown but well known).

The body 12 is substantially U-shaped in the deployed configuration shown in FIGS. 1-2 and has a first body portion 18 connected to a second body portion 20 in a first pivoting engagement 22. This first body portion 18 is formed of a first segment 24 and a second segment 25 which are in a second pivoting engagement 26 therebetween. The second body portion 20 is formed of a third segment 28 and a fourth segment 30, which are in a third pivoting engagement 32 therebetween.

Also shown in FIGS. 1-3 is the central opening 34 which is positioned between the first body portion 18 and the second body portion 20 and the flange 15 which projects away from the segments of the first body portion 18 and the second body portion 20 forming the body 12, substantially along an exterior circumference of the formed body 12. The flange 15 includes a pliable cover 17 engaged thereon in a position wherein a portion of the cover 17 will contact against an underlying toilet seat, with the device 10 positioned thereon.

As shown in FIG. 2 and FIG. 3, on the lower surface 16 of the body 12, the first segment 24 of the first body portion 18 has a first recess 36 formed therein. Also shown is the second recess 38 formed into the lower surface 16 of the third segment 28 of the second body portion 20 of the body 12. As noted, the first recess 36 is dimensioned for a recessed positioning of the second segment 25 therein when rotated to place the body 12 in the collapsed configuration of FIG. 4. Additionally shown, the second recess 38 is dimensioned for a recessed or nesting positioning therein of the fourth segment 30, when the body 12 is configured to the collapsed configuration shown in FIG. 4.

As can be seen in FIGS. 2-3, the first pivoting engagement 22, the second pivoting engagement 26, and the third pivoting engagement 32 may be formed by hinges rotating around an engaged hinge pin 40. However, as noted above, other pivoting engagements which will allow rotational or pivoting engagements between the segments may be employed as would occur to those skilled in the art. For pinch protection of the person sitting atop the device 10, it is preferable that such pivoting engagements provide the biasing force to urge the adjacent engaged components toward each other with the device 10 in the deployed position, as shown for example in FIG. 15 and FIG. 19.

FIGS. 4-8 show the device 10 with the body 12 positioned in the collapsed configuration, from the deployed configuration of FIGS. 1-3. As noted, this change in configuration is accomplished through a sequenced folding of the respective segments forming one of the first body portion 18 or the second body portion 20, and then the other of the first body portion 18 or the second body portion 20. Once the respective segments forming both the first body portion 18 and the second body portion 20 have been folded along broken lines F1 and F2 of FIG. 3, to place the respective second segment 25 into the first recess 36 and the fourth segment 30 into the second recess 38, the first body portion 18 is then folded against the second body portion 20, or vice versa, as shown along broken line F3 of FIG. 3. This sequential folding, such as shown in FIG. 3, positions the body 12 in the collapsed configuration of FIG. 4.

Shown in FIG. 4 is a view of the top surface 14 of the device 10 with the body 12 folded to the noted collapsed configuration. As can be seen and is preferred in all modes of the device 10, in the collapsed configuration, the body 12 has an area defined by the perimeter edge looking from overhead as in FIG. 4, which is substantially 25-30% of the total area of the body 12 as compared with the deployed configuration of FIGS. 1-3.

This recessed positioning of the second segment 25 into the first recess 36 and the recessed positioning of the fourth segment 30 into the second recess 38 located in the third segment 28, and the subsequent folding of the first body portion 18 against the second body portion 20, or vice versa, configures the device 10 to the most compact configuration. In this collapsed configuration it is significantly smaller than the body 12 in the deployed configuration, making it small and compact for carrying in a bag or a purse. Being storable in a small area, the device 10 is easily carried and deployed for use in locations remote to the home.

FIG. 5, as noted, is a side view of the body 12 of the device 10 folded to the collapsed configuration as in FIG. 4. As shown, the second segment 25 is rotationally engaged to the first segment 24 by the second pivoting engagement 26 and is positioned within the first recess 36. Also, the fourth segment 30 is rotationally engaged to the third segment 28 by the third pivoting engagement 28 and rotated to a stowed position within the second recess 38.

This nesting of the second segment 25 within the first recess 36 and the fourth segment 30 within the second recess 38 allows the device 10 to be folded to an overall height which is substantially 20% smaller in a collapsed height, defined by the distance between the upper surface 14 on the first segment 24 and the upper surface 14 on the third segment 28, than it would be without such a nesting configuration.

In FIGS. 5-6, the device 10 is depicted in the collapsed configuration. In the collapsed configuration, the first body portion 18 has been folded against the second body portion 20 such that the top surfaces 14 of the second segment 25 and of the fourth segment 30 are in a contact with each other. The view of the device 10, with the body 12 in the collapsed configuration shown in FIG. 6, is a view opposite the view from the arched edge side of FIG. 5. Also shown are the first endwall 24A and the second endwall 25A on opposing sides of the second pivoting engagement 26, and the third endwall 28A and the fourth endwall 30A on opposing sides of the third pivoting engagement 32. As noted below, these respective endwalls on opposing sides of each of the second pivoting engagement 26 and third pivoting engagement 32 move to form a respective biased contact with each other when the device 10 is moved to the deployed position as in FIG. 1.

Depicted in FIG. 7 is the body 12 of the device 10 in the collapsed configuration as in FIG. 4 but in a perspective view thereof. As can be seen, the second segment 25 is folded and positioned to nest entirely within the first recess 36 in the first segment 24. The fourth segment 30 has been folded to a nesting position entirely located within the second recess 38 of the third segment 28. This configuration, in the collapsed position, can also be seen in FIG. 8, which shows a sectional view of FIG. 7 along line 8-8 shown in FIG. 7. As noted, the nesting of the second segment 25 within the first recess 36 in the first segment 24, and of the fourth segment 30 within the second recess 38 in the third segment 28, significantly reduces the thickness and thus the size of the device 10 in the collapsed configuration.

Additionally shown in an enlarged view in FIG. 8 is the flange 15 which, as noted above, projects from the device 10 substantially about the perimeter thereof. While the device 10 will perform well with the flange 15 in contact with an underlying toilet seat, preferably the pliable cover 17 is engaged to the flange 15 such that the pliable cover 17 will contact against an underlying toilet seat with the device 10 positioned thereon. As noted above, the pliable cover 17 is formed of a pliable polymeric material or a thermoplastic elastomer having a durometer which will aid it to better form to the contour of the underlying toilet seat and to increase both the area of frictional engagement as well as enhancing the frictional engagement itself, and thereby prevent slipping and sliding of the device 10 when deployed.

Depicted in FIGS. 9-10 and 11-13 are views of a preferred pivoting engagement employed between the four segments forming the two body portions of the device 10 such as the second pivoting engagement 26 and third pivoting engagement 32. For ease of explanation, the depicted second pivoting engagement 26 provided by a hinge is shown between the first segment 24 of the first body portion 18 and the second segment 25 of the first body portion 18 in FIGS. 9 and 10 and 11-13. The same configuration is employed to form the third pivoting engagement 32 where hinge members are connected to the third segment 28 and fourth segment 30, and the first projections 41 and second projections 42 are operatively positioned thereon to engage with a locking member 49 as described with relation to the second pivoting engagement 26.

As can be seen in FIGS. 9 and 10, the hinge defining the second pivoting engagement 26 has hinge members 62 with a set of first projections 41 and a set of second projections 42 positioned thereon. Also shown are complementary recesses 43. Each of the complementary sized recesses 43 align respectively with both the first projections 41 and second projections 42.

Sidewalls of each complementary recess 43 will contact and engage with a respective second projection 42 during a "click to close" function to move the device 10 to the collapsed configuration shown in FIG. 7 and to the second locked position. Sidewalls of each complementary recess 43 will contact and engage with a respective first projection 41, during the "click to open" function, to achieve the first locked position which corresponds with the device 10 reaching the deployed position in FIG. 1. This contact, as shown in FIG. 19, also imparts a biasing between the adjacent segments such that the endwalls thereof are in a biased contact towards each other when the device 10 is in the deployed position of FIG. 1. Common to hinges 26 and 32, the first projections 41 and second projections 42 rotate concurrently with rotation of a hinge member 62 portion of the formed hinge, such as that forming the depicted second pivoting engagement 26.

In operation, to move segments of the device 10 to the collapsed configuration, as in FIG. 4, surfaces on or adjacent the second projections 42 will slide past a leading edge of a respective complementary recess 43 located on an adjacent segment such as the depicted first segment 24. As the second segment 25 is rotated toward and into a nesting position within the first recess 36, movement of each second projection 42 past the leading edge and into a respective engagement within a complementary recess 43 will cause an audible sound and/or tactile click or vibration as the second projection 42 passes over a leading edge.

While in the collapsed configuration, each of the second projections 42 will remain in a removably locked engagement within a respective complementary recess 43 in the second locked position. As shown, but common to all the segments in such a pivoting engagement, this second locked engagement of each second projection 42 within a complementary recess 43 holds the second segment 25 in a nesting position within the first recess 36.

Also, as depicted in FIGS. 9 and 10, for convenience but also common to the third pivoting engagement 32, when the second segment 25 is rotated toward the deployed position of the device 10 as in FIGS. 1-2, each first projection 41 will rotate into and form a biased engagement within a respective complementary recess 43 to reach the first locked position. During this movement of each first projection 41 into a respective complementary recess 43, an audible noise and/or tactile feedback for the "click to open" signal is generated. The feedback is generated by movement of the first projections 41 past and over a leading edge on the complementary recesses 43 and a subsequent resulting collision and contact of the contact surface 48 of the second segment 25 against the contact surface 48 of the first segment 24, as shown in FIG. 12. As can be seen in FIG. 19, a biasing force to hold the endwalls of the adjacent segments is imparted by the second pivoting engagement 26 as shown, as well as the third pivoting engagement 32 which operates the same.

This locked engagement of the first projections 41 within the complementary recesses 43 (i.e. the first locked position) also locks the device in the deployed position of FIG. 1. The biased contact of the endwalls of the two segments eliminates gaps between the first segment 24 and the second segment 25 and prevents pinching that would otherwise occur were the device to move slightly in and out of the deployed position of FIG. 1 as a result of the child's movement atop the device. Such moving in and out of the deployed position of FIG. 1 would result in the opening and closing of slight gaps between the first segment 24 and the second segment 25 that could grab and pinch the child's skin.

Shown in FIG. 10A, is a typical pivoting engagement employed for the first pivoting engagement 22 forming a rotating connection between the first body portion 18 with the second body portion 20. With the device 10 moved to the deployed position such as in FIG. 1, the biased contact of the locking members 49 against the locking projections 51, when in the first locked position, will secure and hold the first segment 24 of the first body portion 18 aligned with the third segment 28 of the second body portion 20.

A deflection and rebound of the locking members 49, as the locking projections 51 move over them, will cause additional auditory and/or tactile feedback for a "click to open" signal as the device moves into the first locked position and the endwalls form the biased contact. Movement of the device 10 to the collapsed position will first disengage the locking projections 51 from the locking members 49 and will cause secondary projections 52 to rotate and engage with a second set of second locking members 55 (FIG. 16) that operate in a manner similar to locking members 49. The second locking members 55 are formed on the third segment 28 of the second body portion 20 also shown in FIG. 16.

Also shown in FIGS. 9, 10, and 11-13, curved edges 46 of the adjacent segments are formed at the intersection of the endwalls with the upper surface 14 of the body 12 formed by the adjacent first segment 24 and second segment 25. These same curved edges 46 run along segments 24 and 25, 28 and 30, and additionally between segments 24 and 28, which are adjacent any of the pivoting engagements herein, 22, 26, 32, and are preferred in that such form a V-shaped recess 50 with opposing curved walls, shown for example in FIG. 12. Such a recess 50, formed preferably with opposing curved sidewall portions, is formed along a seam wherever a pivoting engagement is positioned in between the multiple segments of the first body portion 18 and second body portion 20, as well as between the first body portion 18 and the second body portion 20 adjacent the first pivoting engagement 22 therebetween.

The recesses 50 in the top surface 14, so formed adjacent each of the pivoting engagements 22, 26, and 32, with the preferred opposing curved walls 46, in combination with the biased contact of the endwalls of the segments and body portions, define a means to prevent pinching of the skin or body of a user, such as a toddler seated upon the top surface 14 of the body 12 of the device 10.

Shown in FIG. 13, is an exploded view of a pivoting engagement such as formed by a hinge, such as the second pivoting engagement 26, and would be of the same configuration and operation in the third pivoting engagement 32, where hinge members 62 are operatively engaged upon a hinge pin 35 or the like. Such is currently preferred for the second pivoting engagement 26 between the first segment 24 and second segment 25, as well as third pivoting engagement 32 engaged between the third segment 28 and fourth segment 30.

Shown for clarity is one of the plurality of first projections 41 and the plurality of second projections 42 formed upon a hinge member 62, which as noted, will respectively hold the device 10 in either the deployed position of FIGS. 1-2 (i.e. the first locked position) or the collapsed position of FIGS. 4 and 7, (i.e. the second locked position). As noted, when in the deployed position the first projections 41 move to respective biased engagements against the sidewalls within complementary recesses 43, and when in the collapsed configuration, the second projections 42 move to respective engagement within respective complementary recesses 43.

FIGS. 14-16 show additional views of the first pivoting engagement 22 as in FIG. 10A and FIG. 1. As can be seen in FIGS. 14 and 15, the locking member 49 has a leading edge 59 adjacent a ledge 57 or recess thereon. In moving to the locked position used to hold the device 10 in the deployed position, the locking projection 51 will contact and move over the leading edge 59 surface of the locking member 49 and deflect slightly before landing in position against a side surface 61 of the ledge 57.

While the locking projection 51 is shown in FIGS. 14-15 as formed as part of the hinge member 62 which is engaged with the second body portion 20, and the locking member 49 is shown as formed as part of the first body portion 18, such may be reversed. Forming the locking member 49 from a polymeric flexible material allows for the noted temporary slight deflection.

Also best seen in FIG. 15, a biasing force to urge the endwalls 44 and 47 adjacent the first pivoting engagement 22 into a biased contact towards and against each other, is provided by the contact of the locking projection 51 against side surface 61 of the ledge 57. The side slanted surface 61 is sloped and positioned to provide this contact against the side of the locking projection 51 and to impart a biasing force to rotate the hinge member 62 engaged to the second body portion 20 toward the first body portion 18. In this fashion, a biased contact of the endwalls 44 and 47 is formed so long as the device 10 is in the deployed position.

As noted, FIG. 16 depicts a sectional view of the first pivoting engagement 22 between the body portions of the device along line 16-16 of FIG. 14. As shown, the secondary projection 52 will rotate with the first body portion 18, if formed as part thereof, and will contact against and traverse over a leading edge 69 of the secondary locking member 55 and slightly deflect it before the secondary projection 52 contacts within a recess 71 area located upon the secondary locking member 55.

This positioning of the secondary projection 52 within the recess 71 acts to removably hold the first body portion 18 and second body portion 20 in the collapsed position, as in FIG. 7 and FIG. 8. Both the locking member 49 and the secondary locking member 55 are preferably formed of polymeric material which will slightly deflect and slightly flex as either the locking projection 51 or secondary projection 52 traverse across the respective leading edge 59 or 69 surface as the device 10 is moved between the collapsed and deployed configurations.

A tactilely felt and/or audible click occurs as the locking projection 51 and/or the secondary projection 52 traverse over the respective leading edge 59 of the locking member 49 and the second locking member 55 and moves into or out of engagement within a respective ledge 57 or recess 71. Concurrent contact of the two endwalls 44 and 47 adjacent the first pivoting engagement 22 while moving to the biased contact therebetween, will also contribute to the audible click sound and tactilely felt vibration.

Shown in FIG. 17, is another view of the device 10 as in FIGS. 11-13. As can be seen, a hinge member 62 connected to the second segment 25 has the first projection 41 and the second projection 42 formed on the hinge member 62 opposite the position of the first projection 41. The same configuration would be formed in the third pivoting engagement 32 between the third segment 28 and fourth segment 30. Such can also be seen as depicted in FIG. 18 and FIG. 19 which depict the device 10 as in FIG. 17 but in a sectional view through the hinge member 62 connected with the second segment 25.

As can be seen in FIGS. 18-19, rotating the second segment 25 and the hinge member 62 engaged therewith in a clockwise direction toward the first segment 24 will position the first projection 41 into the complementary recess 43 formed into the underside of the first segment 24 to hold the two segments 24 and 25 in the deployed configuration. Rotating the second segment 25 in a counterclockwise direction will concurrently rotate the hinge member 62 to disengage the first projection 41 from the complementary recess 43 and position the second projection 42 within the complementary recess 43 to hold the second segment 25 within the first recess 36 in the first segment 24. The same operation is employed with the third pivoting engagement 32 between the third segment 28 and fourth segment 30. Also, as noted, while the pivoting engagements and hinge members 62 herein are shown as formed as part of a particular component in a rotational engagement with a secondary component, the positions can be reversed.

Shown in FIG. 19 is the biased contact of the first endwall 24A against the second endwall 25A when the second pivoting engagement 26 is moved to the first locked position to hold the device 10 in the deployed position. The first projection 41 is traversed past the leading edge 58 and into the complementary recess 43 where the first projection 41 is in contact against a slanted sidewall 64 of the recess 43. This contact with the sidewall 64 is a biased contact that will continuously urge the hinge member 62 to rotate toward the first segment 24 which imparts a continuous biased contact between the first sidewall 24A and second sidewall 25A with the device 10 locked in the deployed position.

This same biasing action occurs between the sidewalls 28A of the third segment 28 and 30A of the fourth segment 30 (FIG. 5) at the third pivoting engagement 32 as it is structurally and functionally the same as the depicted second pivoting engagement 26. As noted above, it is the biased contact of all the sidewalls positioned at the first pivoting engagement 22, the second pivoting engagement 26, and the third pivoting engagement 32 which prevents gaps from forming and any pinching which might occur where such a biased contact of the respective adjacent endwalls not in place. As such, this biased contact of all opposing respective endwalls at each of the three pivoting engagements is especially preferred herein.

While all of the fundamental characteristics and features of the collapsible toilet seat invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art, for various structural and functional components, without departing from the spirit or scope of the invention or claims herein. Consequently, all such modifications and variations and substitutions are considered to be included within the scope of the invention as defined by the following claims.

What is claimed is:

1. A collapsible toilet seat, comprising:

a body, said body having a deployed position having a substantially U-shape and having an upper surface opposite a lower surface;

said body foldable from said deployed position to a collapsed position;

said body in said deployed position being positionable atop a toilet seat;

said body having a first body portion in a first pivoting engagement with a second body portion;

said first body portion having a first segment in a second pivoting engagement with a second segment;

said second body portion having a third segment in a third pivoting engagement with a fourth segment;

said first segment having a first endwall adjacent said second pivoting engagement and having a second endwall adjacent said first pivoting engagement with said body in said deployed position;

said second segment having a second segment endwall adjacent said first endwall of said first segment, said second segment extending from said second segment endwall to a distal end of said second segment with said body in said deployed position;

a first portion of said upper surface of said body positioned upon said first segment being substantially aligned with a second portion of said upper surface of said body positioned on said second segment with said body in said deployed position;

said third segment having a first endwall adjacent said third pivoting engagement and having a second endwall adjacent said first pivoting engagement with said body in said deployed position;

said fourth segment having a fourth segment endwall adjacent said first endwall of said third segment, said fourth segment extending from said fourth segment endwall to a distal end of said fourth segment with said body in said deployed position;

a third portion of said upper surface of said body positioned upon said third segment being substantially aligned with a fourth portion of said upper surface of said body positioned on said fourth segment with said body in said deployed position;

said body in said collapsed position having said second segment being rotated on said second pivoting engagement to a folded position of said second segment wherein a second portion of said lower surface of said body thereon faces toward a first portion of said lower surface of said body located on said first segment;

said body in said collapsed position having said fourth segment being rotated on said third pivoting engagement to a folded position of said fourth segment wherein a fourth portion of said lower surface of said body thereon faces toward a third portion of said lower surface of said body located on said third segment;

with said second segment in said folded position thereof and said fourth segment in said folded position thereof, said body in said collapsed position having said first body portion being rotated on said first pivoting engagement to locate said fourth portion of said upper surface of said body facing toward said second portion of said upper surface of said body;

said first portion of said lower surface of said body positioned within a first recess;

said third portion of said lower surface of said body positioned within a second recess;

said second segment being positioned within said first recess when in said folded position thereof; and said fourth segment being positioned within said second recess while in said folded position thereof.

2. The collapsible toilet seat of claim 1, additionally comprising:

said first pivoting engagement positionable to a first locked position thereof;

said second pivoting engagement positionable to a first locked position thereof;

said third pivoting engagement positionable to a first locked position thereof; and said first pivoting engagement and said second pivoting engagement and said third pivoting engagement each positioned to a respective first locked position, thereby positioning said body to said deployed position in a first locked position thereof whereby a rotational force must be imparted by a user to disengage each respective said first locked position of each of said first pivoting engagement, said second pivoting engagement, and said third pivoting engagement.

3. The collapsible toilet seat of claim 2, additionally comprising:

movement of said first pivoting engagement into said first locked position thereof generating one or both of a first audible noise and a first vibration of said body;

movement of said second pivoting engagement into said first locked position thereof generating one or both of a second audible noise and a second vibration of said body; and movement of said third pivoting engagement into said first locked position thereof generating one or both of a third audible noise and a third vibration of said body.

4. The collapsible toilet seat of claim 1, additionally comprising:

said first pivoting engagement positionable to a second locked position thereof;

said second pivoting engagement positionable to a second locked position thereof;

said third pivoting engagement positionable to a second locked position thereof; and said first pivoting engagement and said second pivoting engagement and said third pivoting engagement each positioned to a respective second locked position, thereby positioning said body to said collapsed position in a second locked position thereof whereby a rotational force must be imparted by a user to disengage each respective said second locked position of each of said first pivoting engagement, said second pivoting engagement, and said third pivoting engagement.

5. The collapsible toilet seat of claim 4, additionally comprising:

movement of said first pivoting engagement into said second locked position thereof generating one or both of a fourth audible noise and a fourth vibration of said body;

movement of said second pivoting engagement into said second locked position thereof generating one or both of a fifth audible noise and a fifth vibration of said body; and movement of said third pivoting engagement into said second locked position thereof generating one or both of a sixth audible noise and a sixth vibration of said body.

6. A collapsible toilet seat, comprising:

a body, said body having a deployed position having a substantially U-shape and having an upper surface opposite a lower surface;

said body foldable from said deployed position to a collapsed position;

said body in said deployed position being positionable atop a toilet seat;

said body having a first body portion in a first pivoting engagement with a second body portion;

said first body portion having a first segment in a second pivoting engagement with a second segment;

said second body portion having a third segment in a third pivoting engagement with a fourth segment;

said first segment having a first endwall adjacent said second pivoting engagement and having a second endwall adjacent said first pivoting engagement with said body in said deployed position;

said second segment having a second segment endwall adjacent said first endwall of said first segment, said second segment extending from said second segment endwall to a distal end of said second segment with said body in said deployed position;

a first portion of said upper surface of said body positioned upon said first segment being substantially aligned with a second portion of said upper surface of said body positioned on said second segment with said body in said deployed position;

said third segment having a first endwall adjacent said third pivoting engagement and having a second endwall adjacent said first pivoting engagement with said body in said deployed position;

said fourth segment having a fourth segment endwall adjacent said first endwall of said third segment, said fourth segment extending from said fourth segment endwall to a distal end of said fourth segment with said body in said deployed position;

a third portion of said upper surface of said body positioned upon said third segment being substantially aligned with a fourth portion of said upper surface of said body positioned on said fourth segment with said body in said deployed position;

said first pivoting engagement positionable to a first locked position thereof;

said second pivoting engagement positionable to a first locked position thereof;

said third pivoting engagement positionable to a first locked position thereof;

said first pivoting engagement and said second pivoting engagement and said third pivoting engagement each positioned to a respective first locked position, thereby positioning said body to said deployed position in a first locked position thereof whereby a rotational force must be imparted by a user to disengage each respective said first locked position of each of said first pivoting engagement, said second pivoting engagement, and said third pivoting engagement;

said first pivoting engagement in said first locked position generating a first biasing force to form a first biased contact of said second endwall of said first segment against said second endwall of said third segment;

said second pivoting engagement in said first locked position generating a second biasing force to form a second biased contact of said first endwall of said first segment against said second segment endwall; and said third pivoting engagement in said first locked position generating a third biasing force to form a third biased contact of said first endwall of said third segment against said fourth segment endwall.

7. The collapsible toilet seat of claim 6, additionally comprising:

movement of said first pivoting engagement into said first locked position thereof generating one or both of a first audible noise and a first vibration of said body;

movement of said second pivoting engagement into said first locked position thereof generating one or both of a second audible noise and a second vibration of said body; and movement of said third pivoting engagement into said first locked position thereof generating one or both of a third audible noise and a third vibration of said body.

8. The collapsible toilet seat of claim 6, additionally comprising:

said first pivoting engagement being a first hinge having a first hinge member connected to one of said first segment or said third segment;

said first locked position of said first pivoting engagement formed by a first projection positioned on said first hinge member when positioned upon a first side surface located within a first complementary recess positioned on the other of said first segment or said third segment;

said positioning of said first projection upon said first side surface imparting said first biasing force to said first hinge member;

said second pivoting engagement being a second hinge having a second hinge member connected to one of said first segment or said second segment;

said first locked position of said second pivoting engagement formed by a second projection positioned on said second hinge member when positioned upon a second side surface located within a second complementary recess positioned on the other of said first segment or said second segment;

said positioning of said second projection upon said second side surface imparting said second biasing force to said second hinge member;

said third pivoting engagement being a third hinge having a third hinge member connected to one of said third segment or said fourth segment;

said first locked position of said third pivoting engagement formed by a third projection positioned on said third hinge member when positioned upon a third side surface located within a third complementary recess positioned on the other of said third segment or fourth second segment; and said positioning of said third projection upon said third side surface imparting said third biasing force to said third hinge member.

9. The collapsible toilet seat of claim 7, additionally comprising:

a first recess communicating with said upper surface in between said second endwall of said first segment and said second endwall of said third segment;

said second endwall of said first segment having a first curved surface at an intersection thereof with said upper surface and said second endwall of said third segment having a second curved surface at an intersection thereof with said upper surface, said second curved surface extending in an opposite direction from said first curved surface thereby forming a first V-shaped intersection of said first recess with said upper surface;

a second recess communicating with said upper surface in between said first endwall of said first segment and said second segment endwall of said second segment;

said first endwall of said first segment having a third curved surface at an intersection thereof with said upper surface and said second segment endwall of said second segment having a fourth curved surface at an intersection thereof with said upper surface, said third curved surface extending in an opposite direction from said fourth curved surface thereby forming a second V-shaped intersection of said second recess with said upper surface;

a third recess communicating with said upper surface in between said first endwall of said third segment and said fourth segment endwall of said fourth segment; and said first endwall of said third segment having a fifth curved surface at an intersection thereof with said upper surface and said fourth segment endwall of said fourth segment having a sixth curved surface at an intersection thereof with said upper surface, said fifth curved surface extending in an opposite direction from said sixth curved surface thereby forming a third V-shaped intersection of said third recess with said upper surface.

10. The collapsible toilet seat of claim 8, additionally comprising:

a first recess communicating with said upper surface in between said second endwall of said first segment and said second endwall of said third segment;

said second endwall of said first segment having a first curved surface at an intersection thereof with said upper surface and said second endwall of said third segment having a second curved surface at an intersection thereof with said upper surface, said second curved surface extending in an opposite direction from said first curved surface thereby forming a first V-shaped intersection of said first recess with said upper surface;

a second recess communicating with said upper surface in between said first endwall of said first segment and said second segment endwall of said second segment;

said first endwall of said first segment having a third curved surface at an intersection thereof with said upper surface and said second segment endwall of said second segment having a fourth curved surface at an intersection thereof with said upper surface, said third curved surface extending in an opposite direction from said fourth curved surface thereby forming a second V-shaped intersection of said second recess with said upper surface;

a third recess communicating with said upper surface in between said first endwall of said third segment and said fourth segment endwall of said fourth segment; and said first endwall of said third segment having a fifth curved surface at an intersection thereof with said upper surface and said fourth segment endwall of said fourth segment having a sixth curved surface at an intersection thereof with said upper surface, said fifth curved surface extending in an opposite direction from said sixth curved surface thereby forming a third V-shaped intersection of said third recess with said upper surface.

11. A collapsible toilet seat, comprising:

a body, said body having a deployed position having a substantially U-shape and having an upper surface opposite a lower surface;

said body foldable from said deployed position to a collapsed position;

said body in said deployed position being positionable atop a toilet seat;

said body having a first body portion in a first pivoting engagement with a second body portion;

said first body portion having a first segment in a second pivoting engagement with a second segment;

said second body portion having a third segment in a third pivoting engagement with a fourth segment;

a flange extending from a perimeter edge of said body;

said flange forming the contact of said body in said deployed position with said toilet seat; and a gap formed between said lower surface of said body and said toilet seat when positioned thereon.

12. The collapsible toilet seat of claim 7, additionally comprising:

a flange extending from a perimeter edge of said body;

said flange forming the contact of said body in said deployed position with said toilet seat; and a gap formed between said lower surface of said body and said toilet seat when positioned thereon.

13. The collapsible toilet seat of claim 8, additionally comprising:

a flange extending from a perimeter edge of said body;

said flange forming the contact of said body in said deployed position with said toilet seat; and a gap formed between said lower surface of said body and said toilet seat when positioned thereon.

14. The collapsible toilet seat of claim 11, additionally comprising:

a pliable cover positioned upon said flange.

15. The collapsible toilet seat of claim 12, additionally comprising:

a pliable cover positioned upon said flange.

16. The collapsible toilet seat of claim 13, additionally comprising:

a pliable cover positioned upon said flange.

* * * * *